US006234535B1

(12) United States Patent
Roberts

(10) Patent No.: US 6,234,535 B1
(45) Date of Patent: May 22, 2001

(54) PORTABLE CLIPBOARD ORGANIZERS

(75) Inventor: Kenneth Roberts, Readfield, ME (US)

(73) Assignee: Saunders, Winthrop, ME (US)

( * ) Notice: Subject to any disclaimer, the term of this patent is extended or adjusted under 35 U.S.C. 154(b) by 0 days.

(21) Appl. No.: 09/640,793

(22) Filed: Aug. 18, 2000

(51) Int. Cl.[7] ..... B42D 17/00
(52) U.S. Cl. ..... 281/45
(58) Field of Search ..... 281/15.1, 21.1, 281/28, 42, 45, 51; 24/67.7, 67.11; 248/444.1, 451

(56) References Cited

U.S. PATENT DOCUMENTS

| | | | |
|---|---|---|---|
| D. 317,788 | 6/1991 | DeWitt | 281/45 |
| D. 322,891 | 1/1992 | Samuelson . | |
| 2,417,879 | 3/1947 | Merritt . | |
| 2,850,296 | 9/1958 | Ratliff . | |
| 3,215,452 | 11/1965 | Goodwin | 281/45 X |
| 3,977,744 | 8/1976 | DeWitt . | |
| 4,628,572 * | 12/1986 | Chang | 281/45 X |
| 5,658,014 * | 8/1997 | Barker | 281/45 |

* cited by examiner

*Primary Examiner*—Willmon Fridie, Jr.
(74) *Attorney, Agent, or Firm*—Dowell & Dowell

(57) ABSTRACT

A portable clipboard organizer including at least one lower compartment tray which is selectively closed by a lid pivotally attached at one end thereof. The lid functions as a clipboard having a clamp assembly mounted thereto from which extends a clip for engaging an end of the tray to thereby latch the lid to the tray. In a preferred embodiment a holding mechanism is secured to selectively extend upwardly from the clamp assembly for purposes of supporting items above the clipboard and for also providing leverage for opening the clamp assembly.

11 Claims, 2 Drawing Sheets

PORTABLE CLIPBOARD ORGANIZERS

BACKGROUND OF THE INVENTION

1. Field of the Invention

This invention is directed to portable organizers of the type utilized to retain various papers and documents as well as writing instruments and which also functions to provide a writing surface in the form of a clipboard. The invention is more specifically directed to portable clipboard organizers having at least one tray defining a compartment in which various articles may be stored and which is selectively covered by a lid having a clamping mechanism secured thereto for purposes of forming a clipboard writing surface.

2. Brief Description of the Related Art

Portable clipboard organizers are well known and are used frequently by those in professions wherein various documentation must be immediately accessible and wherein writing surfaces are not generally available. Police officers, fire fighters, courier and other delivery personnel, security guards, plant engineers and others frequently use clipboards having storage compartments in which papers which must be relied upon during the course of employment are stored. The organizers are usually carried and, when documentation is necessary, documents or other papers can be removed from the storage compartment and placed on a clipboard surface where the papers can be positively engaged by a clip or clamp assembly. Once documents have been signed or information placed on the documents, the documents can be removed from the clipboard surface and placed for safe storage within the storage compartment.

A number of conventional portable clipboard and storage organizers provide one or more storage trays to which a clipboard member is pivotally secured generally along an upper edge of an uppermost of the trays. The clipboard functions as a lid for closing the underlying storing compartments. Within some organizers, a latch is provided for securing the clipboard or lid member in overlying relationship with respect to the storage compartment(s) which clip is normally provided along the base or bottom of the organizer. Such conventional clipboard organizers are somewhat awkward to handle because of pivot assemblies are provided at an upper portion of the organizers. To gain access to papers in the organizers, the organizers must be opened and, if documents are placed on the clipboard, the documents are pivoted away from the individuals utilizing the organizers.

An additional drawback with conventional clipboard organizers is that the clamp assemblies utilized to secure papers on the surface of the clipboards or lids are spring loaded requiring some effort to be exerted to open the clamps to place or remove papers from the clipboard surfaces.

In addition to the forgoing, there is a need to provide portable clipboard organizers which provide increased utility for supporting more than one document from the surface of the organizers such that individuals can review a plurality of documents at the same time and yet have documents secured so that they need not be manually held. By way of an example, a police officer may wish to support a person's permit or driver's license at the same time the officer notes information on documents, such as citations or tickets.

Some examples of prior art clipboard organizers are disclosed in U.S. Pat. No. 2,850,296 to Ratcliff; U.S. Pat. No. 3,977,744 to Dewitt; U.S. Pat. No. 2,417,879 to Merritt; U.S. Pat. No. 3,215,452 to Goodwin; U.S. Design Pat. Des No. 317,788 to Dewitt; and U.S. Design Pat. Des No. 322,891 to Samuelson et al.

SUMMARY OF THE INVENTION

A clipboard organizer which includes at least one storage tray having opposite upstanding end walls and opposite upstanding side walls which define therebetween at least one storage compartment. A lid is piviotly secured preferably along a lower end wall of the storage tray and is of a size to cover the storage compartment such that items may be stored and closed within the storage compartment. The lid includes a clamp assembly which is mounted thereto adjacent the upper end wall of the tray and includes opposing jaws which are resiliently urged toward one another in order to provide a positive clamping force for securing articles along an upper surface of the lid such that the lid and clamping mechanism form a clipboard structure.

To secure the lid to the at least one underlying tray, a clip extends from the clamp assembly and is engageable generally along the upper end wall of the tray. In a preferred embodiment, an elongated opening may be provided in the upstanding upper end wall of the tray in which a latch portion of the clip may be selectively seated.

In a preferred embodiment of the present invention, a holding mechanism is also mounted generally centrally of a movable jaw of the clamping mechanism. The holding mechanism includes a thumb tab which is mounted in opposing relationship with a spring clip such that articles may be placed between the thumb tab and the spring clip and supported therebetween in space relationship relative to the surface of the lid. The holding mechanism also has utility in providing mechanical leverage by allowing the thumb tab to be engaged to pivot the movable jaw to allow articles to be placed between or removed from the opposing jaws of the clamp assembly. In some embodiments, the holding mechanism may be pivotally attached to the movable jaw thereby allowing the assembly to be raised to a use position extending outwardly relative to the movable jaw.

It is an object of the present invention to provide a clipboard type organizer which includes at least one storage tray to which a lid having a clamp assembly is pivotally secured such that the lid is opened by pivoting about a pivot axis at an end of the tray and preferably toward an individual who would be supporting the organizer so the documents and papers, placed on the surface of the lid which forms a clipboard, will be oriented at all times toward the individual and wherein access can easily be obtained to articles placed within the storage compartment defined by the tray.

It is a primary object of the invention to provide a portable clipboard organizer which provides for increased utility for supporting a variety of documents and which includes not only a clamp assembly for clamping papers or other articles along the surface of a lid forming a clipboard for the organizer but which also incorporates a secondary holding mechanism which can be utilized to support articles in spaced relationship from the surface of the clipboard portion of the organizer and which can also be used to facilitate opening of the clamp assembly.

It is yet a further object of the present invention to provide a portable clipboard organizer which incorporates at least one storage tray and an overlying clipboard assembly which forms a lid for the tray and wherein a plurality of clamp or clip mechanisms are used for securely retaining articles relative to the clipboard assembly.

It is another object of the present invention to provide a portable clipboard organizer which includes at least one tray which is selectively covered by a clipboard assembly and wherein the clipboard assembly includes a clamp mechanism from which extends a clip for securing the clipboard in fixed relationship with respect to the tray and wherein the clip is preferably provided along an upper end wall of the organizer.

BRIEF DESCRIPTION OF THE DRAWINGS

A better understanding of the invention will be had with respect to the following description and drawings wherein.

DESCRIPTION OF THE PREFERRED EMBODIMENT

Figure 1:
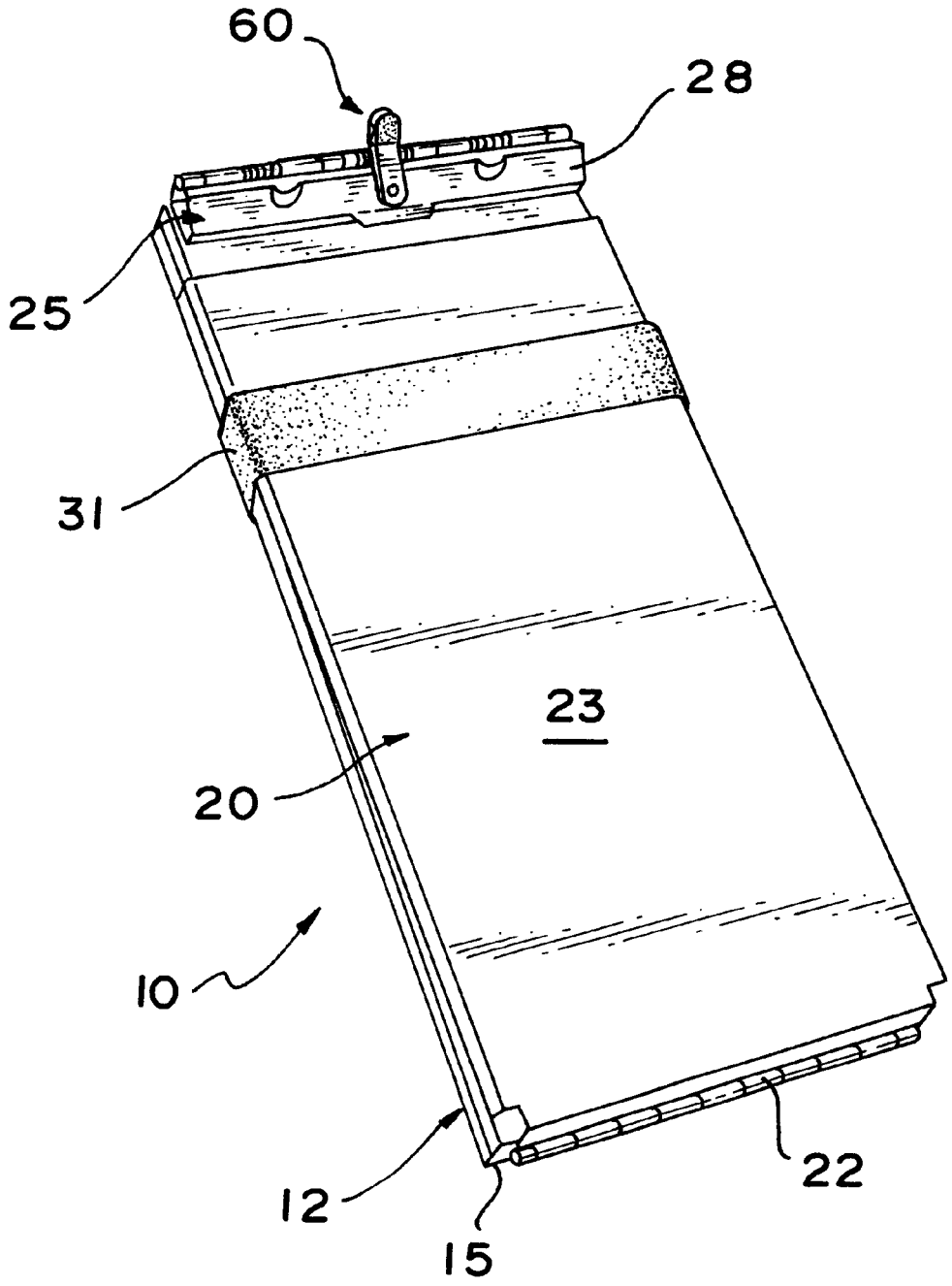
FIG. 1 is a front perspective view of a clipboard organizer in accordance with the teachings of the present invention.
Figure 2:
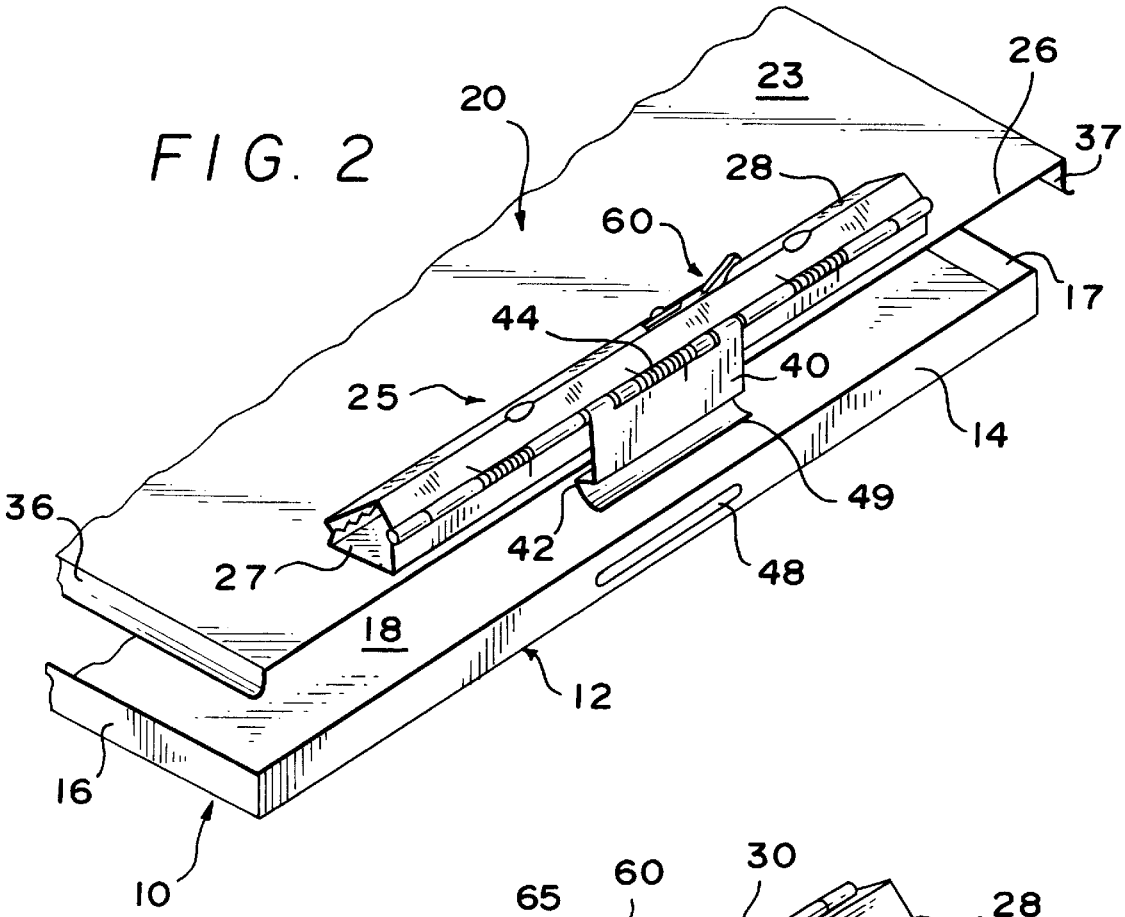
FIG. 2 is a partial enlarged rear perspective view of the clipboard organizer shown is FIG. 1 showing the clipboard being open relative to a lower storage tray.

With continued reference to the drawing figures, the clipboard organizer 10 of the present invention is shown as including at least one lower tray 12 having an upper end wall 14 a lower end wall 15 and opposite spaced and side walls 16 and 17. The walls defined therebetween at least one storage compartment 18 in which a plurality of articles may be stored. Although not shown in the drawing figures, a plurality of sections may be created within the storage compartment for housing different articles such as pens, pencils, clips and other articles which may be necessary in the performance of a particular job.

A lid 20 of a size to completely cover the storage compartment is secured by an elongated hinge 22 to the lower end wall of the tray such that the lid is pivoted upwardly away from the upper end wall of the tray when being opened. The lid 20 includes an upper surface 23 upon which various articles may be placed. To retain the articles on the surface of the lid, a clamp assembly 25 is securely mounted such as by riveting along an upper edge portion 26 of the lid so as to be adjacent the upper end wall of the tray. The clamp assembly includes a lower stationary jaw 27 and a movable jaw 28 each of which are secured in pivotal relationship by a piano-type hinge 29 having associated therewith a plurality of coil springs 30 which normally urge the movable jaw into closed relationship with respect to the fixed jaw. An optional resilient band 31 may also be provided for encircling the lid and tray.

Figure 3:
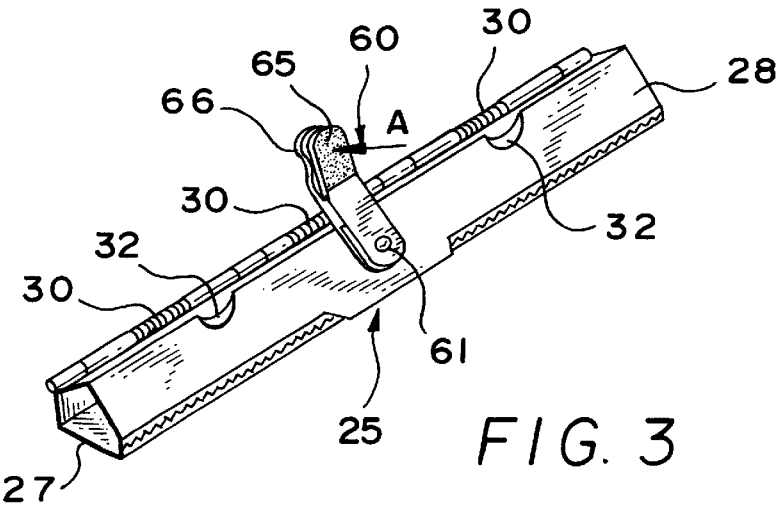
FIG. 3 is a front perspective view of the clamp assembly and holding mechanism of the present invention.

As shown in FIG. 3, the movable jaw of the clamp assembly may have a plurality of openings 32 formed therein which can be utilized to support writing instruments such as pens or pencils when the organizer is in use. To more securely enclose the underlying storage compartment, the lid has opposite depending side walls 36 and 37 which are designed to engage on the outside of the side walls of the tray. In the specific embodiment shown in the drawing figures, the lid does not include any depending upper end wall, however, in some embodiments, a wall may be provided.

In the foregoing description, the lid and the clamp assembly defined together a clipboard assembly which is pivotally attached to the underlying tray. Articles may be stored in the tray and removed there from and placed on the surface of the clipboard assembly and be retained by the clamp assembly.

To secure the clipboard assembly relative to the tray, a clip 40 is pivotally attached to and depends from a fixed portion of the clamp assembly. The clip includes a lower end having an inwardly extending detent or latch portion 42. The clip is also mounted about the piano hinge and a further spring 44 is provided for normally urging the clip into a closed relationship with respect to the tray. Although the clip may be designed to engage over a lower edge of the tray, in the preferred embodiment shown, there is a slot 48 provided in the upper end wall of the tray. The slot is of the size such that the latch or the detent of the clip may be securely seated therein to thereby lock the lid, or the clipboard assembly, relative to the tray. The clip may be released by simply lifting up on the lower edge 49 thereof and pivoting the clip about the hinge 29.

The present invention also provides a holding mechanism 60 which is preferably pivotally secured at 61 to the movable jaw of the clamp assembly. In view of the pivoted attachment, the holding mechanism 60 may be extended upwardly from the clamp mechanism, as shown in FIG. 3, or may be rotated or pivoted to another position extending generally along the length of the movable jaw of the clamp assembly.

The holding mechanism includes a forwardly oriented thumb tab 65 and a rear spring clip 66. Various articles may be placed between the thumb tab and the spring clip and be retained therebetween. In this manner, the holding mechanism may be used for holding articles in spaced relationship above the surface of the clipboard assembly such that one or more documents may be held by the clamp assembly associated with the lid while other documents may be held by the holding mechanism.

The holding mechanism also has utility in providing an opening lever for facilitating the pivotal movement of the movable jaw against the springs which normally urge the movable jaw of the clamp assembly toward a closed position. By raising the holding mechanism to the position shown in FIG. 3, force may be applied against the thumb tab in the direction of the arrow "A" thereby opening the movable jaw relative to the fixed jaw.

In the use of the clipboard organizer of the present invention, the clip may be pivoted from the slot in the upper end wall of the underlying tray and the clipboard assembly pivoted toward an individual holding the organizer. Documents or other articles may be placed into or removed from the storage compartment and thereafter the clipboard assembly pivoted to a closed position and the clipboard assembly secured as the latch of the spring loaded clip will automatically engage within the slot in the end wall of the tray. In the event it becomes necessary, documents may be secured to the upper surface of the lid utilizing the clamp assembly. To facilitate opening of the clamp assembly, the holding mechanism is pivoted to the position shown in FIG. 3 and pressure placed against the thumb tab to pivot the movable clamping jaw relative to the fixed jaw. When necessary, other documents or articles may be placed between the thumb tab and the spring clip of the holding mechanism with such documents or articles supported in spaced relationship with respect to the surface of the clipboard assembly.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A portable clipboard organizer including a tray having upper and lower end walls and spaced side walls defining a storage compartment therebetween, a lid overlying said storage compartment so as to selectively close said storage compartment, said lid having first and second ends, pivot means for pivotally securing said first end of said lid to said lower end wall of said tray, a clamp assembly mounted to said lid adjacent said second end thereof whereby said lid and said clamp assembly function as a clipboard member, said clamp assembly including a fixed clamping jaw and an opposing movable clamping jaw, means for resiliently urging said movable clamping jaw toward said fixed clamping jaw about a pivot axis, means for securing said clipboard member to said tray, a holding mechanism mounted to said clamp assembly and including a thumb tab and an opposing spring clip between which articles may be selectively engaged so as to be supported above an upper surface of said lid, and said thumb tab being engagable to provide leverage to open said movable clamping jaw relative to said fixed clamping jaw of said clamp assembly.

2. The portable clipboard organizer of claim 1 in which said means for securing said clipboard member to said tray includes a clip mounted to said clamp assembly, said clip including a catch, said catch being engageable with said upper end wall of said tray.

3. The portable clipboard organizer of claim 2 including an elongated slot in said upper end wall of said tray, said catch being engagable within said slot to thereby secure said clipboard member to said tray.

4. The portable clipboard organizer of claim 3 including means for resiliently mounting said clip about said pivot axis to thereby normally urge said catch of said clip toward engagement within said slot.

5. The portable clipboard organizer of claim 4 in which said holding mechanism is pivotally mounted to said movable clamping jaw of said clamp assembly.

6. The portable clipboard organizer of claim 5 including at least one opening provided in said movable clamping jaw of said clamp assembly.

7. The portable clipboard organizer of claim 1 which said holding mechanism is pivotally mounted to said movable clamping jaw of said clamp assembly.

8. The portable clipboard organizer of claim 1 in which said lid includes depending opposite side walls.

9. A portable clipboard organizer including a tray having upper and lower end walls and spaced side walls defining a storage compartment therebetween, a lid pivotally mounted to said tray so as to be movable to selectively open and close said storage compartment, said lid having opposite end portions, a clamp assembly mounted to one of said end portions so as to be adjacent an end wall of said tray whereby said lid and said clamp assembly function as a clipboard member, said clamp assembly including a fixed clamping jaw and an opposing movable clamping jaw, means for resiliently urging said movable clamping jaw toward said fixed clamping jaw, a holding mechanism mounted to said movable clamping jaw and including a tab and an opposing spring clip between which articles may be selectively engaged so as to be retained in spaced relationship with respect to an upper surface of said lid.

10. The portable clipboard organizer of claim 9 in which said holding mechanism is pivotally secured to said movable clamping jaw of said clamp assembly.

11. The portable clipboard organizer of claim 10 including a clip mounted to said clipboard member for selectively securing said clipboard member to said tray.

* * * * *